United States Patent [19]

Poe et al.

[11] 4,307,905

[45] Dec. 29, 1981

[54] TOGGLE LATCH ASSEMBLY

[75] Inventors: L. Richard Poe, Long Beach; William R. Bourne, Anaheim, both of Calif.

[73] Assignee: Hartwell Corporation, Placentia, Calif.

[21] Appl. No.: 76,977

[22] Filed: Sep. 20, 1979

[51] Int. Cl.[3] ..... E05C 3/08

[52] U.S. Cl. ..... 292/200; 292/DIG. 31; 292/DIG. 49

[58] Field of Search ..... 292/200, 113, 247, DIG. 31, 292/DIG. 49

[56] References Cited

U.S. PATENT DOCUMENTS 2,610,880 9/1952 Gayner et al. ..... 292/DIG. 31
2,621,952 12/1952 Gander ..... 292/DIG. 31
2,874,986 2/1959 Henricks ..... 292/DIG. 31
3,047,321 7/1962 Gander ..... 292/DIG. 31

*Primary Examiner*—Richard E. Moore
*Attorney, Agent, or Firm*—Lyon & Lyon

[57] ABSTRACT

A toggle latch having three linkage means, the first and third linkage means being pivotally connected to a frame and the second linkage means being pivotally connected between the first and third linkage means. The first linkage means having a pivot slidably restrained within a frame aperture for moving between a first position when the toggle latch assembly is secured and a second position where the toggle latch assembly is opened. In one embodiment, a forth linkage means is positioned between the frame and the slidable pivot of the first linkage means in order to decrease the frictional loading on the slidable pivot.

5 Claims, 10 Drawing Figures

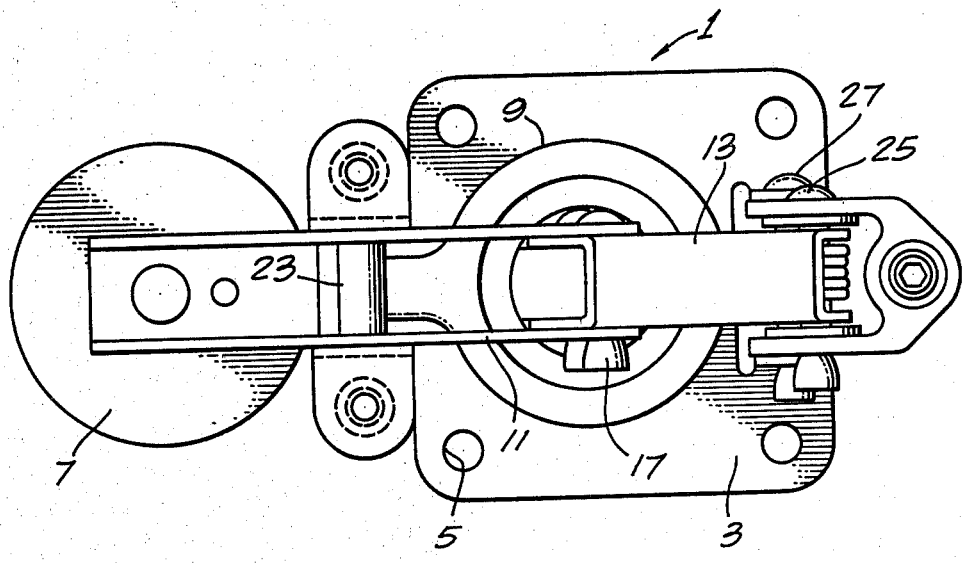
FIG. 4.
FIG. 5.
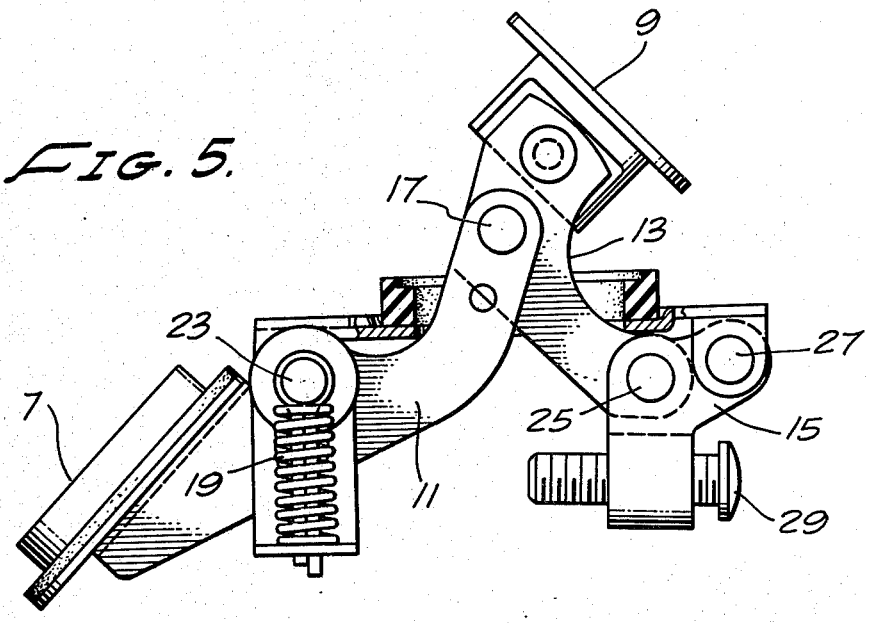

TOGGLE LATCH ASSEMBLY

BACKGROUND OF THE INVENTION

The invention relates to a toggle latch assembly. More particularly, it relates to a toggle latch assembly wherein the configuration of the toggle may be slideably reciprocated between first and second positions wherein the assembly in the first of said positions provides for a securely held toggle latch assembly, while movement of the toggle latch into the second position or configuration allows for the latch to be easily opened.

SUMMARY OF THE INVENTION

A toggle latch assembly having a bracket means and first and second linkage means joined by a first moveable pivot. The first linkage means is connected to the bracket means by a second moveable pivot which is constrained to slide within a slot or aperture provided in the bracket means. The second linkage means is connected to the bracket means through a third linkage means, the third linkage means being adapted to pivot about a fixed pivot attached to the bracket means, and the second and third linkage means being joined by a third moveable pivot.

Such a latch assembly allows for the second moveable pivot to be moved between first and second predetermined positions whereby when the second moveable pivot is in the first of said preselected positions where the toggle configuration is one wherein the toggle is secure. Upon sliding the second moveable pivot to its second predetermined position, the toggle configuration is such that the toggle is moved and easily opened.

The purpose of this invention is to provide an improved toggle latch. Other objects and advantages of this invention will become evident upon a full reading of the specifications, drawings and claims.

BRIEF DESCRIPTION OF THE DRAWINGS

FIG. 4 is a bottom view of the toggle latch assembly.

FIG. 5 is a partial cross-sectional view of a toggle latch assembly illustrating the assembly in the open position.

DESCRIPTION OF PREFERRED EMBODIMENTS

Figure 1:
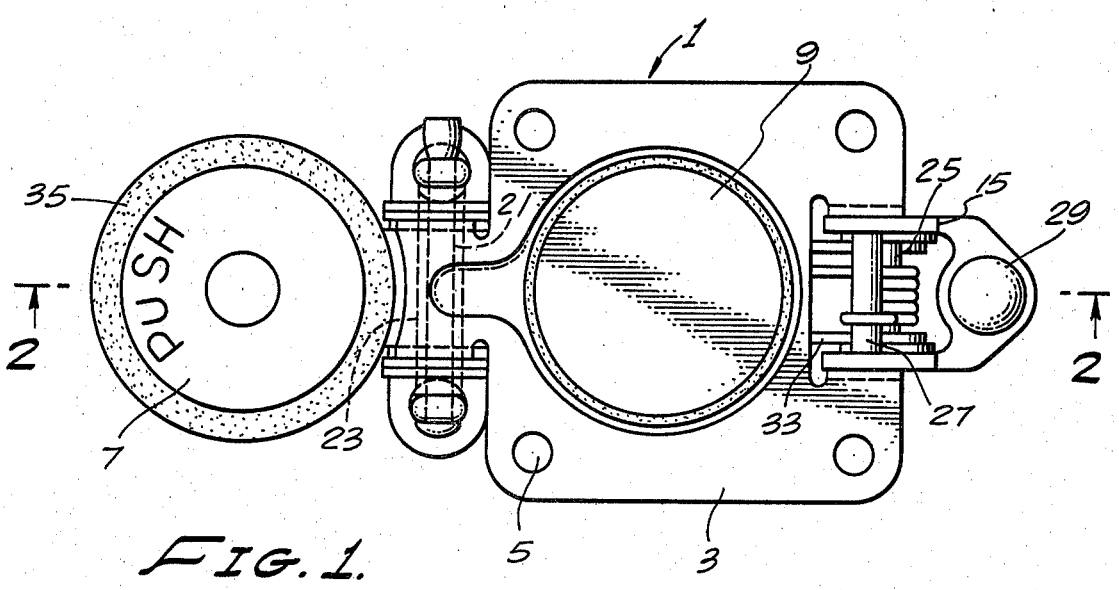
FIG. 1 is a top view of the toggle latch assembly.

Referring to FIG. 1, the toggle latch assembly 1 includes the bracket 3 having a plurality of mounting holes 5 for mounting the bracket to a panel, or the like, (not shown) for securing said panel when the toggle assembly 1 is in the closed position (See FIG. 2) and for allowing for the removal of such panel when the toggle latch assembly 1 is opened (See FIG. 5). The toggle latch assembly 1 includes an opening mechanism 7 and a closing mechanism 9 which may be depressed in order to open and close the toggle latch assembly 1, respectively.

Figure 2:
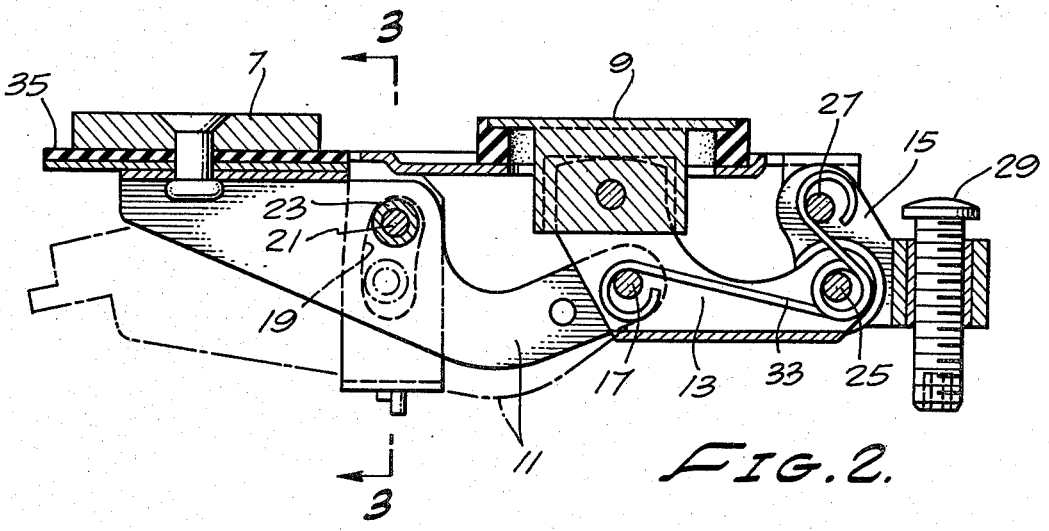
FIG. 2 is a sectional view through 2—2 of FIG. 1.
Figure 3:
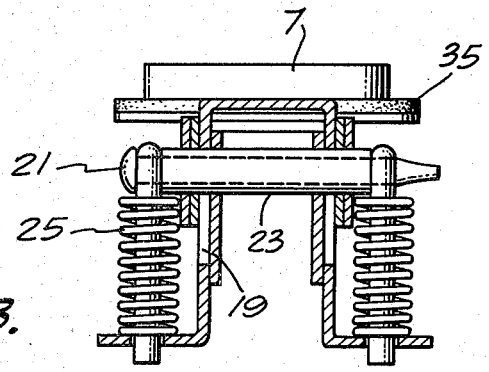
FIG. 3 is a sectional view through 3—3 of FIG. 2.
Figure 6:
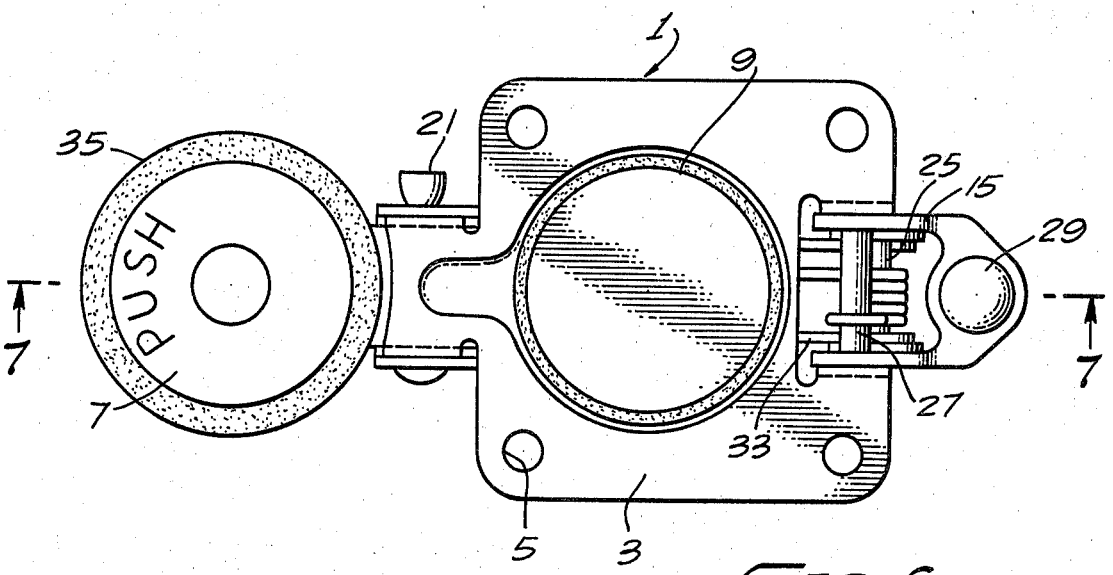
FIG. 6 is a top view of a toggle latch assembly.

Referring now to FIG. 2, it may be seen that the toggle latch assembly 1 includes a first linkage means 11, a second linkage means 13 and a third linkage means 15. The first linkage means 11 and the second linkage means 13 are joined by a first moveable pivot 17.

The bracket 3 includes an aperture or slot 19 within which a second moveable pivot 21 is slideably mounted. A roller 23 may be provided about the second moveable pivot 21 in order to facilitate the slideable movement of the second moveable pivot 21 within the aperture 19. As illustrated in FIG. 2 a biasing means such as spring 25 is positioned between a portion of the bracket 3 and the second moveable pivot 21 such that the second moveable pivot 21 is urged toward a first predetermined position as illustrated in FIG. 2.

The second linkage means 13 is operatably connected to the third linkage means 15 by means of a third moveable pivot 25. The third linkage means 15 is in turn connected to the bracket 3 by means of a fixed pivot 27. A bolt or the like 29 may be attached to the third linkage means 15 such that bolt bears upon the panel (not shown) to be secured.

Referring now to FIG. 5, the operation of the toggle latch assembly 1 will be discussed. When it is desired to open the toggle latch assembly, the opening mechanism 7 is depressed such that the slideably mounted second moveable pivot 21 assumes a second predetermined position shown dotted in FIG. 2. Further movement of the opening mechanism 7 beyond the position shown in dotted form in FIG. 2, allows the first linkage means 11 to pivot about a second moveable pivot 21 thus urging the first moveable pivot 17 and the closing mechanism 9 upwardly and causing the third linkage means 15 and the third moveable pivot 25 to rotate in clockwise manner as shown in FIG. 5.

After the toggle latch assembly 1 has been fully opened as shown in FIG. 5, the force exerted on the open mechanism 7 may be removed thus allowing the second moveable pivot 21 to float and to return to the first predetermined position as shown in FIG. 2. When it is desired to close the toggle latch assembly 1, the closing mechanism 9 is depressed by means of an external force thus urging the first, second and third linkage means, 11, 13 and 15, respectively, to assume the position illustrated in FIG. 2, the third linkage means pivoting about the third moveable pivot 25, while the second linkage means 13 pivots about the first moveable pivot 17 and the first linkage means 11 pivots about the second moveable pivot 21.

Figure 7:
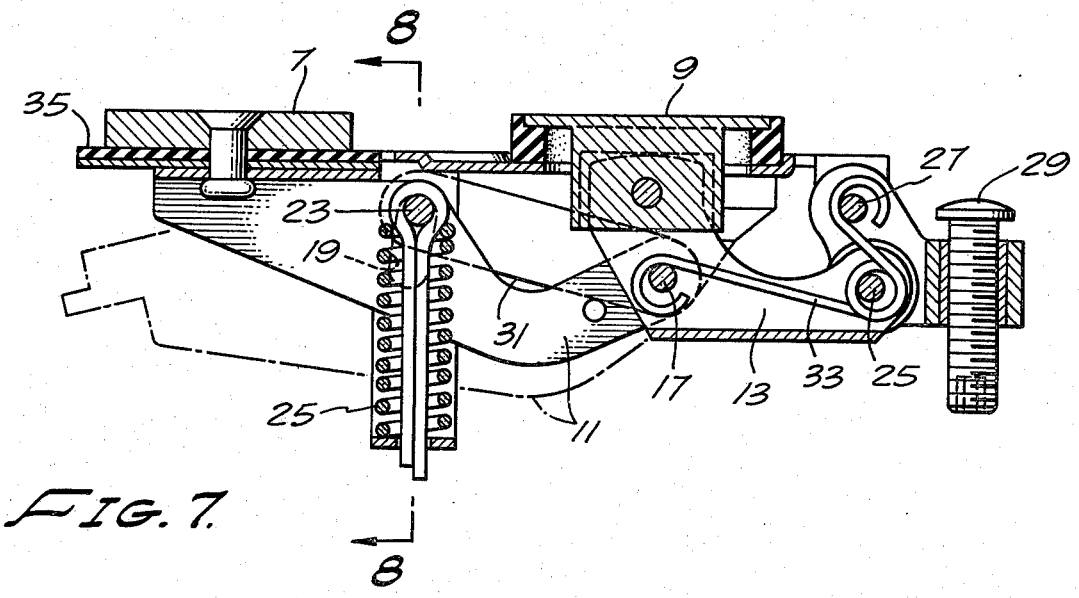
FIG. 7 is a sectional view through 7—7 of FIG. 6.
Figure 8:
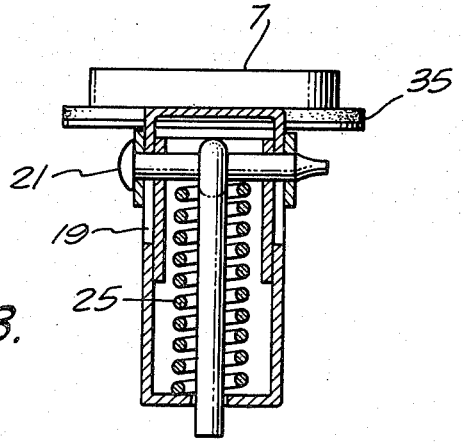
FIG. 8 is a sectional view through 8—8 of FIG. 7.
Figure 9:
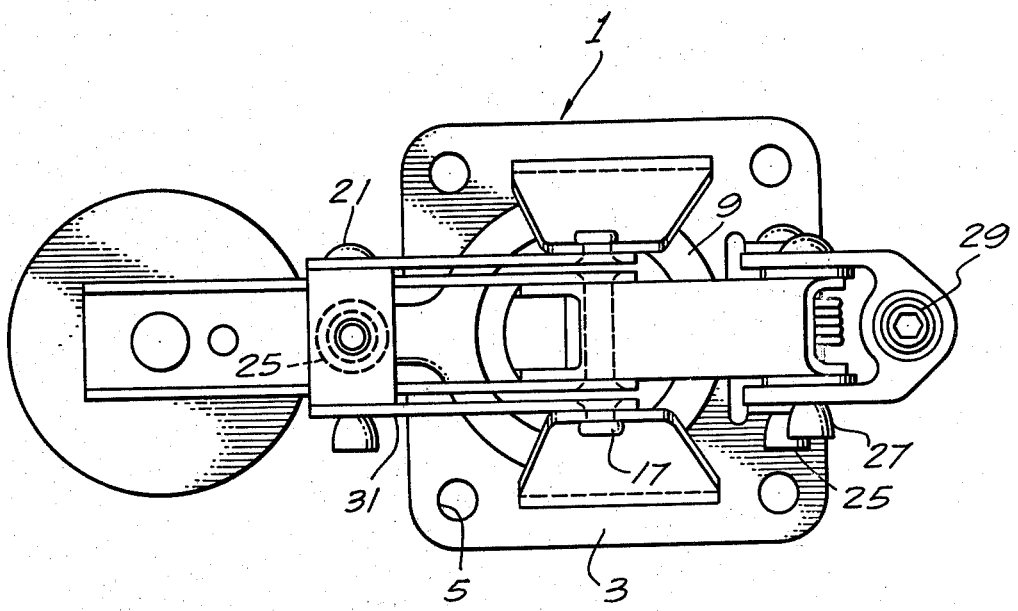
FIG. 9 is a bottom view of the toggle latch assembly.
Figure 10:
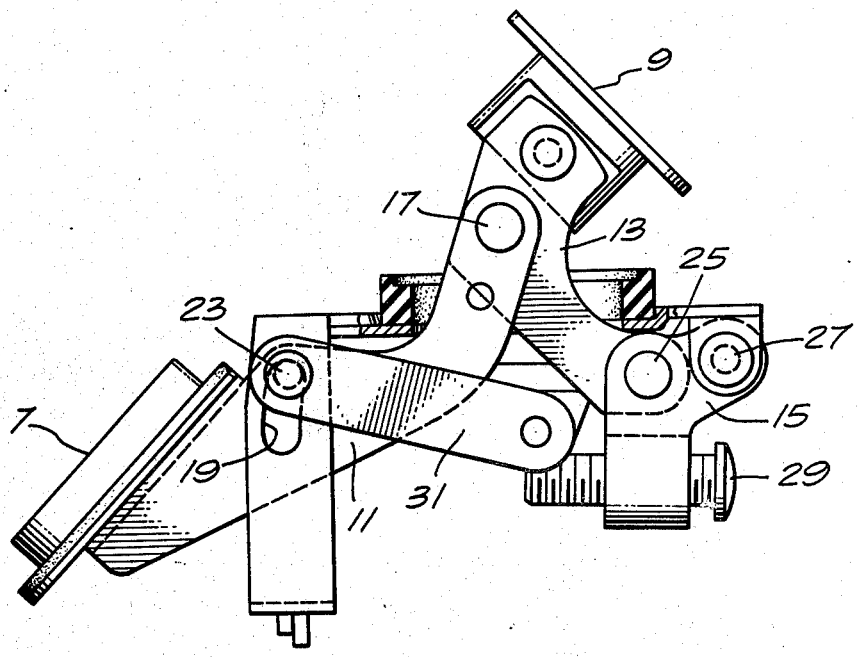
FIG. 10 is a partial cross-sectional view of the toggle latch assembly showing the assembly in the open position.

Referring now to FIG. 7, a configuration of the toggle latch assembly 1 shown which is similar to the toggle latch assembly 1 shown in FIGS. 1–5 but further includes a fourth linkage means 31 between the first and second moveable pivots, 17 and 21 respectively. The function of the fourth linkage means 31 is to transfer the frictional forces between the roller 23 of the second moveable pivot 21 and the slot 19, to the bracket 3. As shown in FIG. 9, the connection between the fourth linkage means 31 and the bracket 3 is illustrated.

A biasing means such as torsional spring 33 may be utilized in order to urge the first moveable pivot 17 away from the fixed pivot 27. Further, gasket means 35 may be positioned about the opening and closing mechanism, 7 and 9 respectively, in order to provide a secure seal.

The importance of providing a slideable mounting for the second moveable pivot 21 becomes apparent when it is understood that when the second moveable pivot 21 assumes the second predetermined position, shown dotted in the bottom of slot 19 in FIG. 2, the toggle is more easily opened. The only force which is required to insure that the toggle be more easily opened in such force as is required to depress biasing means 25. When such a force is removed, and the toggle latch assembly 1 returns to its closed position as shown in FIG. 2, the position of the second moveable pivot 21 with respect to the other pivots of the toggle latch assembly 1 insures that the toggle latch assembly will remain secured.

Modifications and variations in the toggle latch assembly can be made in the light of the teachings of this invention. It is therefore understood that within the scope of the impending claims the invention may be practiced otherwise than as specifically described.

What is claimed is:

1. A toggle latch assembly comprising:

a bracket means; first and second linkage means, said first and second linkage means being joined by a first moveable pivot, said first linkage means being connected to said bracket means by second moveable pivot constrained to slide within a slot provided in said bracket means, and said second linkage means being connected to said bracket means through a third linkage means, said third linkage means adapted to pivot about a stationary pivot attached to said bracket means, and said second and third linkage means being joined by a third moveable pivot.

2. The toggle latch assembly claimed in claim 1 wherein said second moveable pivot is further defined as including a roller placed about said pivot within said slot, said second moveable pivot roller having an external diameter which is slightly less than the slot width.

3. The toggle latch assembly claimed in claim 1 wherein biasing means are positioned between said frame and said second moveable pivot whereby biasing said second moveable pivot to assume a first predetermined position, said second moveable pivot assuming a second predetermined position on exertion of an external force in opposition to said biasing means.

4. The toggle latch assembly claimed in claim 3 wherein an opening mechanism is operatively connected to said first linkage means and a closing mechanism is operatively connected to said second linkage means.

5. A toggle latch assembly comprising:

a bracket means; first and second linkage means, said first and second linkage means being joined by a first moveable pivot, said first linkage means being connected to said bracket means by a second moveable pivot constrained to slide within a slot provided in said bracket means, and said second linkage means being connected to said bracket through a third linkage means, said third linkage means adapted to pivot about a stationary pivot attached to said bracket means, and said second and third linkage means being joined by a third moveable pivot, and a fourth linkage means positioned between said frame and said second moveable pivot for decreasing the frictional loading on said second moveable pivot.

* * * * *